US007396015B2

(12) United States Patent
Feola

(10) Patent No.: US 7,396,015 B2
(45) Date of Patent: Jul. 8, 2008

(54) METHOD OF PLAYING A POKER-TYPE GAME

(75) Inventor: John Feola, North Reading, MA (US)

(73) Assignee: New Vision Gaming & Development, Inc., North Reading, MA (US)

( * ) Notice: Subject to any disclaimer, the term of this patent is extended or adjusted under 35 U.S.C. 154(b) by 15 days.

(21) Appl. No.: 11/184,268

(22) Filed: Jul. 19, 2005

(65) Prior Publication Data

US 2007/0018399 A1 Jan. 25, 2007

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 5,382,025 A * 1/1995 Sklansky et al. ..... 273/292
5,584,486 A * 12/1996 Franklin ..... 273/292
5,664,781 A 9/1997 Feola
5,839,731 A * 11/1998 Feola ..... 273/292
5,845,907 A 12/1998 Wells
5,951,012 A * 9/1999 Feola ..... 273/292
5,984,779 A * 11/1999 Bridgeman et al. ..... 463/16
6,379,245 B2 4/2002 De Keller
6,718,291 B1 * 4/2004 Shapiro et al. ..... 703/2
6,719,291 B1 4/2004 deKeller
6,780,104 B2 8/2004 Fox
2007/0069470 A1 * 3/2007 Snow ..... 273/292
2007/0080496 A1 * 4/2007 Feola ..... 273/292
2007/0085273 A1 * 4/2007 Feola ..... 273/292

* cited by examiner

*Primary Examiner*—Eugene Kim
*Assistant Examiner*—Dolores R. Collins
(74) *Attorney, Agent, or Firm*—Altman & Martin; Steven K Martin

(57) ABSTRACT

A method of playing a poker-type game where two cards are revealed in each of a plurality of hands followed by a player wagering on at least one of the hands. Three community cards are revealed followed by a second round of wagering where the player must either raise or fold each hand wagered on in the previous wager round. The three community cards are part of each hand. Two more community cards are revealed and the winning hand is determined where each hand is a combination of the first two cards and the five community cards.

9 Claims, 5 Drawing Sheets

| Hand | Win Frequency |
|---|---|
| 2♣ - 7♥ | 8.00% |
| 5♦ - 5♥ | 18.32% |
| Q♠ - J♠ | 27.87% |
| 8♦ - 9♦ | 21.24% |
| A♣ - K♥ | 25.39% |

FIG. 4

| Hand | Flush or Less | Full House or Better |
|---|---|---|
| 2♣ - 7♥ | 2 to 1 | 25 to 1 |
| 5♦ - 5♥ | 2 to 1 | 6 to 1 |
| Q♠ - J♠ | 2 to 1 | 3 to 1 |
| 8♦ - 9♦ | 2 to 1 | 10 to 1 |
| A♣ - K♥ | 2 to 1 | 5 to 1 |

FIG. 5

| Hand | Payout |
|---|---|
| Royal Flush | 50 to 1 |
| Straight Flush | 25 to 1 |
| Four of a Kind | 5 to 1 |
| Full House | 2 to 1 |
| Flush | 1 to 1 |

FIG. 6

| Hand | Payout |
|---|---|
| Royal Flush | 1000 to 1 |
| Straight Flush | 500 to 1 |
| Four of a Kind | 200 to 1 |
| Full House | 50 to 1 |
| Flush | 25 to 1 |
| Straight | 15 to 1 |
| Three of a Kind | 5 to 1 |
| Two Pair | 3 to 1 |
| Any Pair | 1 to 1 |

FIG. 7

| Hand | Payout |
|---|---|
| Straight Flush | 40 to 1 |
| Three of a Kind | 30 to 1 |
| Straight | 6 to 1 |
| Flush | 4 to 1 |
| Pair | 1 to 1 |

FIG. 8

METHOD OF PLAYING A POKER-TYPE GAME

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to games of chance, more specifically, to a game based on poker in which necessary knowledge of the game is minimized and skill is not a factor in playing.

2. Description of the Related Art

Texas Hold'em, a form of stud poker, has seen its popularity skyrocket as a result of various television shows that feature the game. With the popularity, many people are playing the game at home and more casinos are installing tables for the game. While watching people playing on these shows and at neighborhood gatherings, a novice to the game may feel overwhelmed and intimidated. This intimidation can take the form of feelings of embarrassment at not knowing how to play the games or not being able to play as fast or well as others, and can manifest itself by not trying the game or even in not gambling at all.

Texas Hold'em is played with a standard deck of 52 cards. The dealer deals out a hand to each player. Each hand receives two cards face down (the hole cards). The player to the left of the dealer antes an amount equal to half the minimum bet (the small blind) and the player to that player's left antes an amount equal to the minimum bet (the big blind). All players except the small and big blinds look at their hands and a round of wagering takes place, beginning with the player to the left of the big blind. After the round of wagering is complete, three community cards are dealt face up in the center of the table (the flop), followed by a second round of wagering beginning with the player to the dealer's left. After the second round, another community card is dealt face up (the turn card), followed by a third round of wagering. After the third round, the fifth community card is dealt face up (the river card), followed by the final round of wagering.

After the final round of wagering, each player turns their hole cards face up. The highest hand that can be made with any combination of a player's hole cards and the five community cards wins the pot. If two or more players have the same hand, the next highest card in each of the tied players' hands (the kicker) is used as a tie-breaker. If there is no kicker, that is, the tied players used both hole cards or have the same hand, the pot is split between them.

As is clear, many wagering choices need to be made by each player during the course of the game. For the player that is unsure of herself, this can be a cause of anxiety and intimidation, especially when playing along side people who are experienced in the game.

BRIEF SUMMARY OF THE INVENTION

It is an object of the present invention to provide a game that is suitable for use in gambling.

Another object is to provide a game suitable for use in gambling based on a game where the player can feel comfortable learning the game.

Yet another object is to provide a game suitable for use in gambling based on a game where minimal knowledge of the rules of the game is necessary to play the game.

A further object is to provide a game suitable for use in gambling based on a game where the player can acquire knowledge of the rules of the game as games are played.

The present invention provides a game based on Texas Hold'em poker where little knowledge of the rules of Texas Hold'em poker is necessary to play. In the current implementation, there are five, revealed, two-card hands and five hidden community cards. The community cards are part of all five hands. A player wagers on one or more of the five hands to be the winning hand. After wagering, three of the community cards are revealed. The player must then either raise or fold each hand previously wagered. The last two community cards are revealed and the winning hand is determined.

The playing surface has a central dealer position with five card locations for each of the community cards. Player positions surround the dealer position. Each player position has a plurality of hand locations. Each hand location has a wager spot that represents the first cards of a hand and a raise spot. Since the first two cards of each hand are fixed, every game begins with the same five hands so that the odds of winning are known and remain the same from game to game. Also, the fixed cards are removed from the deck of playing cards.

To begin, a player selects the hand or hands that she thinks will win by placing the amount to be wagered on the wager spot of the desired hand. The dealer deals out the community cards face down in the community card locations. Since the community cards are part of every hand, the only difference between hands is the first two cards. After the first wagering round, the dealer reveals three community cards, followed by a second wagering round where the player must either wager an additional amount or fold each previously wagered hand. The remaining two community cards are revealed and the winning hand is determined by comparing the hands based on a predetermined criteria. Typically, the winning hand will be the highest rank among the best five cards. It does not matter if no one wagered on a particular hand, it may still be the winning hand. A player that wagered on the winning hand receives a predetermined payout according to a pay table.

Optionally, side bets, set jackpots, and/or progressive jackpots may be played as an adjunct to the game of the present invention. One optional side bet allows a player to wager that a particular hand will have a rank that is found in a pay table. Optionally, the hand is limited to the winning hand. Another optional side bet allows a player to wager that the hand composed only of the community cards will have a rank that is found in a pay table. Another optional side bet allows a player to wager that the hand composed only of the first three community cards will have a rank that is found in a pay table.

The present invention contemplates that the game may be played using other media, such as scratch or pull-tab tickets, video poker-type machines, personal computers, hand-held devices, slot machines, over an on-line computer network, or on another type of one-way or interactive gaming or entertainment equipment, such as keno-style or lottery-style equipment.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein:

FIG. 4 is a table showing the winning frequency for each of the five hands of FIG. 2;

FIG. 5 is an example pay table for hands of FIG. 2;

FIG. 6 is an example pay table for the optional seven-card bonus side bet;

FIG. 7 is an example pay table for the optional community card bonus side bet;

FIG. 8 is an example pay table for the optional flop bonus side bet;

DETAILED DESCRIPTION OF THE INVENTION

The present invention provides a game based on Texas Hold'em poker where little knowledge of the rules of Texas Hold'em poker is necessary to play. The game is played with a basic set of rules and includes several optional enhancements. The essence of the game is that a player wagers on one or more hands that she hopes will be the winning hand. The chances of winning are not enhanced by the skills of the player because the players do not play against each other. Because a player can wager on any hand, it is irrelevant to each player how the other players are playing the game, for example, which hands they are wagering on and how much they are wagering.

The game of the present invention is played with a standard 52-card deck of playing cards. The present invention contemplates that more than one deck may be used and/or that wild cards, such as jokers, may be used. In the present implementation, standard poker rankings determine winning hands.

The term "playing card" is used in the present application to indicate a playing card, a symbol representing a playing card, any facsimile thereof. For example, a playing card can be a paper playing card, a representation of a card on a table layout, an image of a card on a video display, an image of a card on a scratch ticket, etc. Any representation of a playing card is contemplated.

In the game as it is currently implemented, there are five hands, each having two predetermined revealed (face up) cards, and five hidden (face down) community cards. The community cards are part of all five hands. In other words, each hand consists of the two predetermined cards and the five community cards. A player can wager on one or more of these five hands to be the winning hand. After wagering, three of the community cards are revealed. The player must then either raise or fold each hand previously wagered. The last two community cards are revealed and the winning hand is determined.

Before game play begins, the house selects the rules of the game to be played, which includes such items as the cards for the predetermined hands, how many hands are dealt, the ranking of hands, how the winning hand will be determined, and any side bets that are permitted. The number of hands dealt is not related in any way to the number of players, so it does not matter how many players there are in the game. There may be from two hands up to the maximum number of hands that can be made from the number of playing cards available. For a standard 52-card deck, there can be as many as 23 hands.

Figure 1:
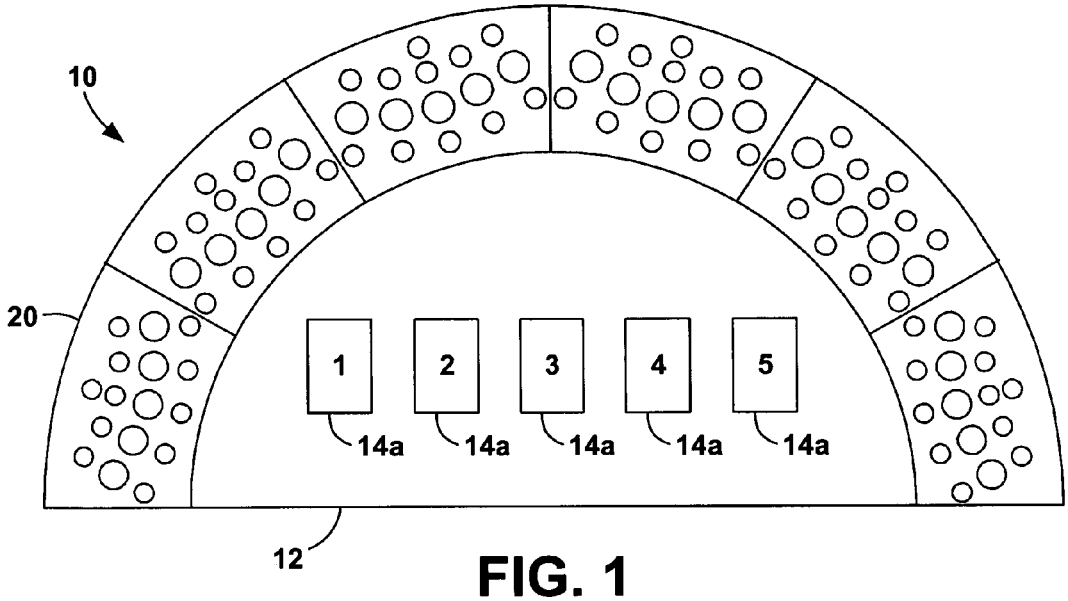
FIG. 1 shows a table layout of the game of the present invention.
Figure 2:
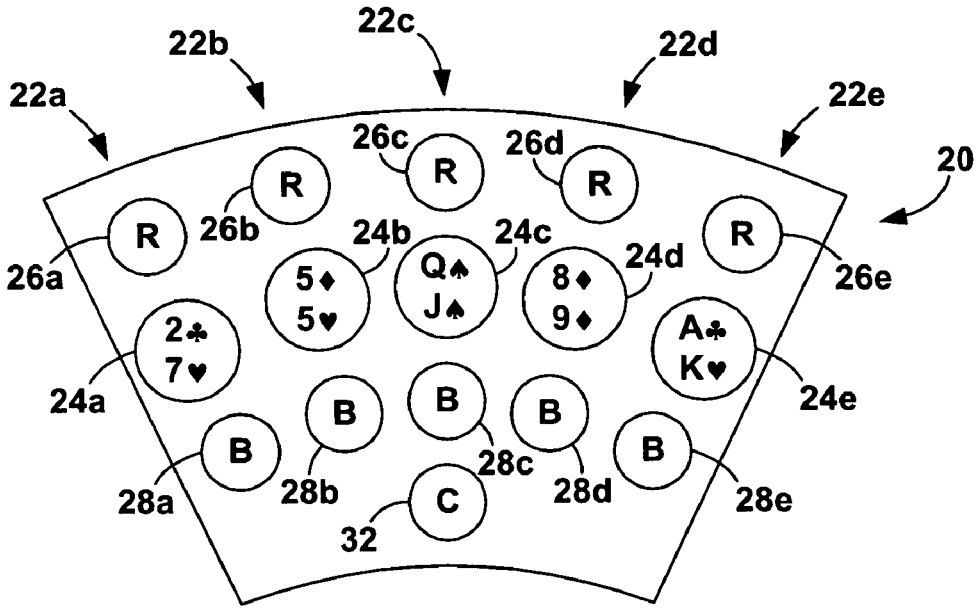
FIG. 2 shows a detail of one version of a player location of the table layout of FIG. 1.
Figure 3:
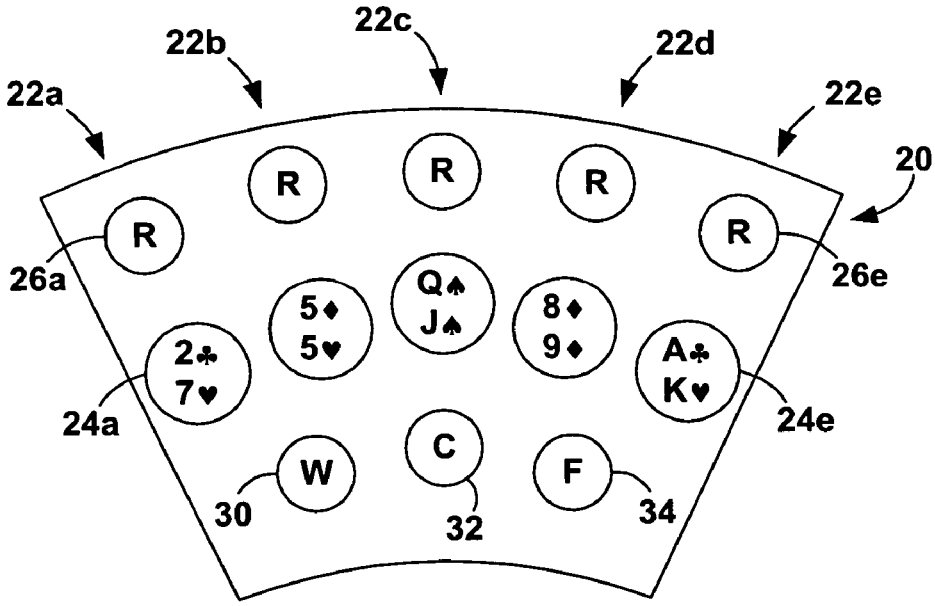
FIG. 3 shows a detail of a second version of a player location of the table layout of FIG. 1.

The game is played on a playing surface, typically a tabletop, although other playing surfaces are contemplated, as described below. Example configurations of a playing surface 10 are shown in FIGS. 1-3. The playing surfaces 10 of FIGS. 1-3 are merely examples and any other playing surface configuration that provides the functionality needed to play the game of the present invention is contemplated.

The central dealer position 12 has five card locations 14*a*-14*e* (collectively, 14), one location for each of the community cards.

The dealer position 12 is surrounded by a plurality of identical player positions 20. Typically, the player positions 20 are evenly spaced in a semicircle around the dealer position 12. Typically, there are six player positions 20, but because the number of players is not related to the number of player hands, the number of player positions 20 may vary. Each player position 20 has a plurality of hand locations. In the example of FIG. 2, there are five hand locations 22*a*-22*e* (collectively, 22). Each hand location 22 has a wager spot 24*a*-24*e* (collectively, 24) and a raise spot 26*a*-26*e* (collectively, 26).

The wager spot 24 represents the first cards of a hand. In the present implementation, this is two cards, although the present invention contemplates one, two, three, or some other number of first cards. In the present implementation, the first cards for each hand are predetermined, that is, each hand has the same first cards for every game. To highlight this, optionally, the predetermined cards for each hand are printed on the playing surface. In the example of FIG. 2, hand A has a 2 of clubs and a 7 of hearts, hand B has a 5 of diamonds and a 5 of hearts, hand C 22 has a jack of spades and a queen of spades, hand D has a 9 of diamonds and an 8 of diamonds, and hand E has an ace of clubs and a king of hearts. These particular card combinations are chosen for the odds of winning that each hand represents. The win frequency for each hand, a proxy for the odds of winning, is shown in FIG. 4. The present invention contemplates that the hands can have any desired two card combinations.

In the present implementation, where the first two cards of each hand are fixed, every game using the same playing surface begins with the same five hands. This means that the odds of winning are known and remain the same from game to game. A player does not have to figure out the odds of winning for each hand for every game, simplifying the game for beginners, which is one of the objects of the game.

As indicated above, the present implementation of the game is played with a standard deck of 52 playing cards. However, because the present implementation fixes the first cards of each hand, those cards are removed from the deck so that there are no duplicates. In the example of FIG. 2, the 2 and ace of clubs, the 5, 8, and 9 of diamonds, the 5, 7, and king of hearts, and the jack and queen of spades are removed, so that there are 44 cards remaining in the deck.

To begin the game, each player selects the hand or hands that she thinks will win. In the present implementation, the hand that ends up with the highest poker rank is the winning hand. The present invention does contemplate that other criteria may determine the winning hand, for example, the lowest poker rank. The selections are made in this first round of wagering by placing the amount to be wagered on the wager spot 24 of the desired hand. The wagered amount is indicated by any marker or markers that acceptably signify value, such as cash, chips, credit vouchers, or other cash equivalents.

Before, during, or after the wagers are placed, the dealer deals out a number of community cards face down in the community card locations 14. Alternatively, one or more of the community cards may be face up. The community cards are considered to be part of every hand, which means that the only difference from one hand to another is the first two cards of each hand. In the present implementation, there are five community cards, but any number may be used.

After the first round of wagering, the dealer reveals the community cards in the first three locations 14*a*-14*c* by turning them face up. At this point, a second round of wagering takes place. For each hand that the player wagered on, the player must either wager an additional amount or fold the hand. The player makes an additional wager by placing a marker in the corresponding R spot 26. In the present implementation, the additional wager is equal to the first wager. After this second round of wagering, the remaining two community cards 14*d*, 14*e* are revealed by turning them face up. Alternatively, rather than a second round of wagering, all of the community cards 14*a*-14*e* are revealed after the first round of wagering.

In the present implementation, the community cards are all dealt face down before, during, or after the first round of wagering and then turned over to reveal the card value when needed during the game. Alternatively, each community card may be dealt face up as it is needed during the game.

The winning hand is determined by comparing the hands based on a predetermined criteria. In the present implementation, that criteria includes determining which hand has the highest rank among the best five cards of each hand where, as indicated above, each hand consists of the first two cards plus the five community cards. If two or more hands tie, all of the tied hands are considered to be the winning hand. It does not matter if no one wagered on a particular hand, it may still be the winning hand. A player that wagered on the winning hand is a winning player. The winning player receives a predetermined payout according to the pay table in use.

Optionally, the payout is based on the rank of the winning hand. A sample of such a pay table is shown in FIG. 5, where a player wagering on the winning hand receives a payout of 2 to 1 if the hand has a flush or lower. If the winning hand has a full house or higher, a player wagering on the winning hand receives a payout shown in the table. The payout is based on the odds that the hand will achieve the ranking. For example, the odds that hand A (2 of clubs/7 of hearts) will end up with a ranked hand are much worse than that of hand 2 (5 of diamonds/5 of hearts). This difference is reflected in the payout for the two hands, as can be seen in the "Full House or Better" column of the payout table of FIG. 5.

Optionally, side bets and/or jackpots may be played as an adjunct to the game of the present invention. Those players that play the game are given the option of playing a side bet or jackpot. It is optional with the house whether or not to allow a side bet or jackpot to be played without also playing the game. Only those players who wager on a side bet before a game begins are eligible to win that side bet on the completion of the game.

A jackpot may be "set" or "progressive". In a set jackpot, the amount put into the jackpot for each game is fixed, but the fixed amount may be adjusted periodically, for example, after the jackpot is won. If more than one eligible player wins a set jackpot, each winner is paid a predetermined amount. In a progressive jackpot, the amount put into the jackpot increases for each game played during which the jackpot is not won. If more than one eligible player wins a progressive jackpot, its value is divided equally among the winners.

One contemplated bonus side bet or jackpot allows a player to wager that a particular hand will have a rank that is found in a pay table, whether or not the hand is a winning hand. If the player wishes to place this side bet, he indicates so by placing the amount to be wagered on the appropriate B spot 28*a*-28*e* of the desired hand or hands, shown in FIG. 2. The side bet is won if the rank of the hand is found in the pay table. An example pay table for this side bet is shown in FIG. 6.

Alternatively, the side bet is limited to the rank of the winning hand. If the player wishes to place this side bet, he indicates so by placing the amount to be wagered on the W spot 30, shown in FIG. 3. If the winning hand has a rank that is found in the pay table, the side bet is won. The side bet does not require that the player wager on the winning hand.

Another possible form of a bonus side bet or jackpot allows a player to wager that the hand composed only of the community cards will have a rank that is found in a pay table. If the player wishes to place this side bet, he indicates so by placing the amount to be wagered on the C spot 32, shown in FIG. 2. The side bet is won if the rank of the community cards is found in the pay table. An example pay table for this side bet is shown in FIG. 7.

Another possible form of a bonus side bet or jackpot allows a player to wager that the hand composed only of the flop will have a rank that is found in a pay table. The flop is composed of the first set of community cards that are revealed. In the present implementation, this is the first three community cards in locations 14*a*-14*c*. If the player wishes to place this side bet, he indicates so by placing the amount to be wagered on the F spot 34, shown in FIG. 3. The side bet is won if the rank of the community cards is found in the pay table. An example pay table for this side bet is shown in FIG. 8.

optionally, the jackpots from more than one table may be linked together as a single jackpot.

The present invention contemplates that, rather than being played on a table surface with a live dealer, the game is played using other media, such as scratch or pull-tab tickets, video poker-type machines, personal computers, hand-held devices, slot machines, over an on-line computer network, or on other types of one-way or interactive gaming or entertainment equipment, such as keno-style or lottery-style equipment.

Figure 9:
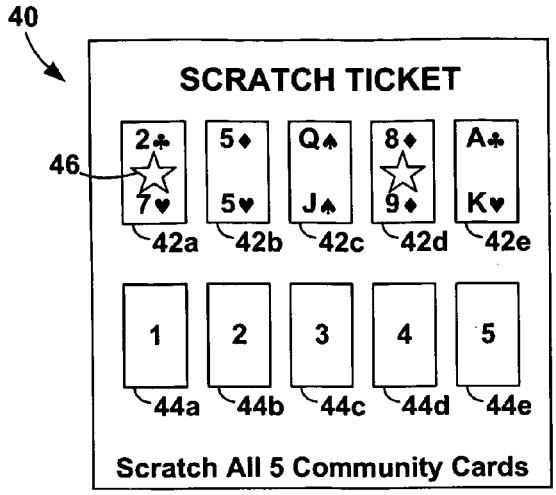
FIG. 9 shows a scratch ticket implementing the basic game of the present invention.

In one example of a scratch ticket 40, shown in FIG. 9, the five two-card hands 42*a*-42*e* are shown exposed and there is a scratch location 44*a*-44*e* for each of the community cards. The player selects one or more hands to be played and the ticket 40 is marked to show the selection(s). In the ticket of FIG. 9, the two selected hands are marked with a star 46. The community cards are randomly selected prior to printing. The player scratches to reveal the community cards 44*a*-44*e*. The ticket is a winning ticket if the player selected the winning hand.

Figure 10:
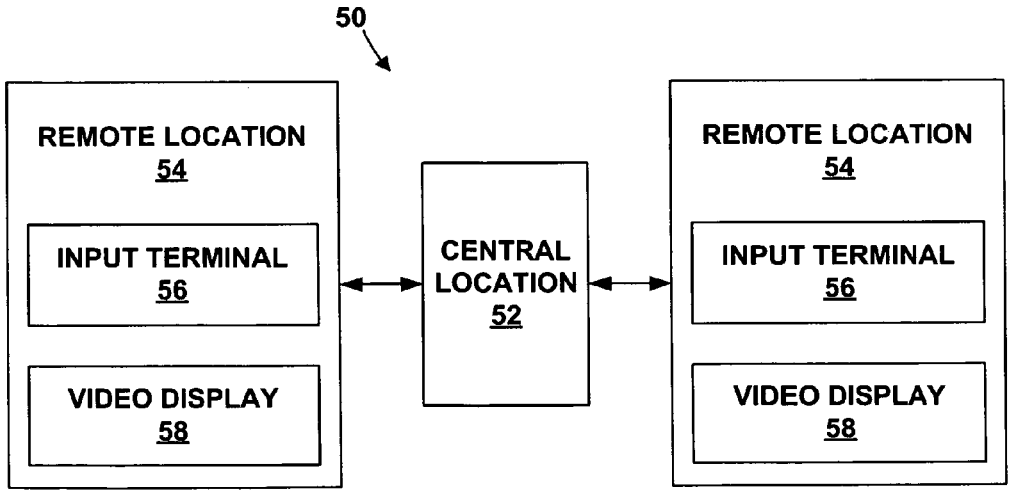
FIG. 10 shows a block diagram of a keno-style system implementing the basic game of the present invention.

In a keno-style lottery system 50, a block diagram of which is shown in FIG. 10, a player typically makes her choice of player hands at a remote location 54 by marking a slip of paper with the hands she wishes to wager on and the wager amount. She gives the slip to a clerk with the amount of the wager in cash, who then scans the slip into a terminal 56 that sends the choices to a central location 52. Alternatively, choices can be made from keys on a keyboard, keys on a key grid, or by boxes on a touch screen grid. Alternatively, the player many request a "quick pick," where the input terminal 56 or central location 52 randomly chooses a hand or hands for the player. The player receives a receipt, such as a paper receipt, or other acknowledgement, such as an indication on a private terminal, indicating the hand or hands chosen for the game. As the game is being played, the hands are displayed on a video screen 58 or matrix of video screens visible to the players at the remote location 54 from information received from the central location 52.

Figure 11:
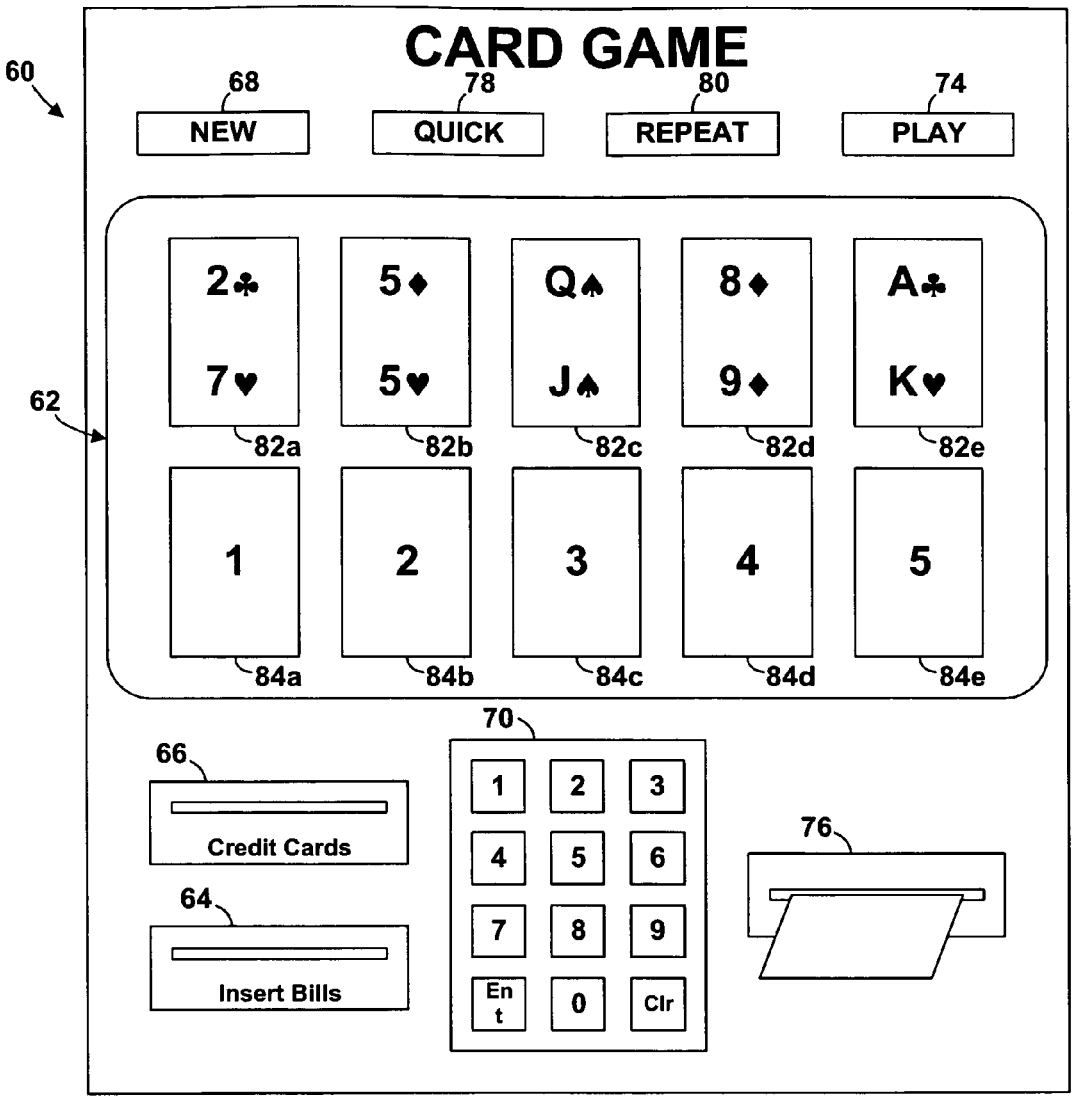
FIG. 11 shows a video screen implementing the basic game of the present invention.

With individual machines, an example of which is shown in FIG. 11, each player has her own terminal 60. An example is a video machine at a gaming establishment. The predetermined cards of the five hands 82*a*-82*e* are displayed on the player's video screen 62. Prior to playing a game, the player inserts cash, a voucher, or a paper ticket, into a money reader 64 or swipes a credit card, debit card, or player card in a card reader 66. The player begins a game by pressing the NEW button 70 and entering the hands on which the player wishes to wager and amount to wager using the keypad 70 or a touch screen 62. The player presses the PLAY button 74 to reveal the first three community cards 84*a*-84*c*. The player can either fold or raise each of the previously selected hands. The player presses the PLAY button 74 again to reveal the last two community cards 84*d*, 84*e* and to determine if the player won. Winning amounts are credited to the player and may be printed on a voucher 76 for payment by a cashier or they may be paid in coins or other monetary tokens by the terminal itself. Optionally, the terminal 60 may include a QUICK button 78 to provide the player with a "quick pick" option, and/or a REPEAT button 80 so that the player may repeat the selections from the previous game.

Alternatively, the standalone machine may be a personal computer, hand-held device, or mobile telephone. The standalone machine can be part of a wired or wireless network. Wagers can be made by debits to credit cards, debit cards, or other cash equivalent. Payouts can be made by crediting credit cards, debit cards, or other bank account, by dispatching gifts, or by any other method wherein the player is credited with the amount won.

Thus, it has been shown and described a poker-type game that satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

I claim:

1. A method of playing a poker-type game with at least one 52-card deck of playing cards, said method comprising the following steps in the order set forth:

(a) providing a plurality of hands, each of said hands having a first at least one playing card, said first at least one playing card for all of said plurality of hands being revealed to at least one player prior to said at least one player wagering;

(b) at least one of said at least one player becoming a wagering player upon wagering on at least one of said hands as wagered hands in a first wagering round;

(c) before, during or after said wagering, dealing out a second at least one playing card as a community card;

(d) revealing said community card after said first wagering round, said community card being part of each of said hands;

(e) determining a winning hand from said hands; and (f) identifying a winning player as a wagering player that wagered on said winning hand.

2. The method of claim 1 further comprising the steps of, after revealing said community card and prior to determining said winning hand, said at least one player either folding or wagering an additional amount on each of said wagered hands in a second wagering round, dealing out a third at least one playing card as an additional community card, and then revealing said additional community card after said second wagering round, said additional community card being part of each of said hands.

3. The method of claim 2 wherein said first at least one playing card is two playing cards, said community card is three playing cards, and said additional community card is two playing cards.

4. The method of claim 2 further comprising the steps of:

(a) providing a side bet on which a player can wager;

(b) a player wagering on said side bet; and (c) paying said player a predetermined amount if said community card has a predetermined combination of playing cards.

5. The method of claim 2 further comprising the steps of:

(a) providing a side bet on which a player can wager;

(b) a player wagering on said side bet; and (c) paying said player a predetermined amount if a combination of said community card and said additional community card has a predetermined combination of playing cards.

6. The method of claim 1 further comprising the steps of:

(a) providing a side bet on which a player can wager;

(b) a player wagering on said side bet; and (c) paying said player a predetermined amount if said winning hand has a predetermined combination of playing cards.

7. The method of claim 1 wherein said winning hand has the highest poker rank.

8. The method of claim 1 wherein said winning player is paid an amount based on the rank of said winning hand.

9. The method of claim 1 wherein said winning player is paid an amount based on the rank of said winning hand and on the rank of said first at least one playing card of said winning hand.

* * * * *